United States Patent [19]

You

[11] Patent Number: 5,045,095

[45] Date of Patent: Sep. 3, 1991

[54] DUST COLLECTOR FOR AN AIR CLEANER

[75] Inventor: Hee S. You, Seoul, Rep. of Korea

[73] Assignee: SamSung Electronics Co., Ltd., Suwon, Rep. of Korea

[21] Appl. No.: 537,998

[22] Filed: Jun. 14, 1990

[30] Foreign Application Priority Data

Jun. 15, 1989 [KR] Rep. of Korea ..... 89-8267[U]

[51] Int. Cl.[5] ..... B03C 3/00

[52] U.S. Cl. ..... 55/139; 55/151

[58] Field of Search ..... 55/2, 139, 151, 136, 55/137; 422/22, 121; 361/230, 231, 235; 219/10.81

[56] References Cited

U.S. PATENT DOCUMENTS 1,343,285 6/1929 Schmidt ..... 55/136

1,507,687 9/1924 Schmidt ..... 55/2

2,297,933 10/1942 Yonkers ..... 422/22

4,516,991 5/1985 Kawashima ..... 55/139

*Primary Examiner*—Bernard Nozick

*Attorney, Agent, or Firm*—Robert E. Bushnell

[57] ABSTRACT

An air cleaner comprises a dust collector of the positive corona using high voltage source, for example DC 7KV, to collect the dust particles in the air, a plurality of ionizing wires function as the heating wire, and the separate voltage source for the ionizing wire is a relatively lower voltage source, for example DC 24V, DC 48V, which may be overrided comparing with the voltage difference between the electrifying panel and the ionizing wire so as to prevent the ill influence on the electrifying function and the dust collecting function. Therefore, an air cleaner can combine air with heating a room so as to make air in the room comfortable.

12 Claims, 3 Drawing Sheets

DUST COLLECTOR FOR AN AIR CLEANER

BACKGROUND OF THE INVENTION

The invention relates to an air cleaner, and particularly, to a dust collector for an air cleaner whose ionizing wire acts as a electric heating wire to heat room as well as to clean air.

In general, an air cleaner comprises a plurality of string or wire type electrodes, a plurality of flat surface electrodes and a high voltage DC power source for supplying high voltage to said both electrodes in order to use the corona discharge between two electrodes having a high voltage difference from each other, so that the unequal electric field is formed between wire electrodes and flat surface electrodes, respectively. That is, as the high voltage is applied to both electrodes having geometrical structure of the line to the surface to generate the corona discharge, the air containing dust particles is passed through the air ion flowing to make the dust into a electric charge based on the fact that the ions are impinged against the solid dust particles and are attached thereto, and the dusts in air are collided with ions by the thermal movement (Brownian movement). Such charged dust particles in the air are collected at the collecting portion of an air cleaner.

A conventional dust collector equipped in an air cleaner is schematically shown in FIG. 4. As shown in FIG. 3, a plurality of dust collecting electrodes 1 made of a conductive metal such as aluminum are arranged at a predetermined gap, for example 10 mm, to each other. A plurality of ionizing wires 2 are disposed at the middle position between two dust collecting electrodes 1, respectively. Ionizing wires 2 are connected to the positive (+) of a high voltage source, for example 7 KV, and dust collecting electrodes 1 are connected to the negative (−), so that the dust particles in the air are made into a positive electric charge by the positive corona discharge. Therefore, when high voltage is applied to the both of electrodes, the positive charged dust particles are collected at the negative dust collecting electrodes by an electric field formed respectively between ionizing wires 2 and dust collecting electrodes 1.

On the other hand, an industrial dust collecting apparatus of one step type generally uses negative corona discharge to make the dust particles into a negative electric charge in order to increase the current density. It has the possibility for recollecting the dust particles scattered again from dust collecting electrodes because a plurality of dust collecting electrodes are arranged along the air flow. Also, a dust collecting apparatus of two step type used mainly in an air cleaner forms the electric fields of the electrifying portion and the dust collecting portion by the separate power sources. Then, the corona discharge normally generates somewhat noxious gases such as Ozone $O_3$, $NO_2$ etc. Therefore, an air cleaner is adapted to use the positive corona discharge for making the dust particles into the electric field, in which the positive corona discharge generates a relatively smaller amount of the corona discharge and Ozone comparing with the negative corona discharge.

But, even though a dust collecting apparatus uses the positive corona discharge to produce a relatively small amount of the corona discharge and noxious gases, it must be equipped with at least one active carbon filters for decomposing the ozone at the air inlet and/or outlet ports, and a dust collecting electrodes may be treated with ozone decomposition accelerating silver plating layers. Herein, it is known that if a home air cleaner uses the negative corona discharge with such harmful gases as the ozone or the nitrogen dioxide being removed, an dust collecting apparatus can be installed in a home air cleaner independent upon the use of the negative corona discharge as well as can use the positive corona discharge.

Also, the user may feel the need for a the separate room heating in using an air cleaner, especially in the winter, but any technical contents related with the room heating in a conventional air cleaner has not been disclosed.

Also, considering that an air cleaner is always used in the indoor, it could not have avoided the contamination of the dust or the microbe due to the convection in the enclosed space when used for a long period. It has been requested to clean the inner portion of an air cleaner for removing of the accumulated dust and the bacteria with the contamination removing device.

An example of an air cleaner having the ozone decomposing function is disclosed in U.S. Pat. No. 4,516,991. This cleaning apparatus which comprises a plurality of dust collecting panel electrodes and corresponding panel electrodes arranged, respectively opposite to each other at a predetermined interval to form air flow passages in a casing having an air flow inlet and an outlet, and a number of ionizing wires installed at a predetermined distance from the ends of the dust collecting panel electrodes substantially on extension lines extended from the respective corresponding electrodes outwardly from the intervals. Furthermore, the dust collecting panel electrodes, the corresponding panel electrodes, and the ionizing wires may be provided at narrow intervals so that the corresponding panel electrodes and the ionizing wires is equal polarity to that of the dust collecting panel electrodes. The voltage applied between the dust collecting panel electrodes and the corresponding panel electrodes is set to substantially one-second of that applied between the dust collecting panel electrodes and the ionizing wires, and the length of the intervals between the dust collecting panel electrodes and the corresponding panel electrodes is of a predetermined potential gradient in response to the applied voltage value. In addition, ozone decomposing accelerating noble metal plating layer is coated on each of the dust collecting panel electrodes and the corresponding panel electrodes, and an ozone decomposing filter formed of activated coal being arranged at the air flow outlet. This air cleaning apparatus of the invention can thus improve the dust collecting efficiency in a sufficient degree in practical use and can reduce the ozone flow rate.

But this patent doesn't disclose the technical contents that an air cleaner heats room when the indoor temperature is below a predetermined temperature.

Accordingly, the object of the invention is to provide a dust collector for an air cleaner for heating of a room if the indoor temperature is a relatively lower.

The other object of the invention is to provide a dust collector for an air cleaner for sterilizing of the bacteria harmful to human body, if necessary, as well as for heating of a room by heating an air to be cleaned.

Therefore, according to the invention, an air cleaner comprises a dust collector of the negative corona using high voltage, in which a plurality of dust collecting panels are connected to a high voltage source, for example DC 7 KV to collect the dust particles in air, a plurality of ionizing wires function as the heating wire, and the separate voltage source heats said ionizing wires. Also, the voltage source for the ionizing wire is a relatively lower voltage source, for example DC 24 V, DC 48 V which may be overrided comparing with the voltage difference between the electrifying panel and the ionizing wire so as to prevent the ill influence on the electrifying function and the dust collecting function.

Therefore, a plurality of electrifying panels are connected at their one ends to the plus terminal of a high voltage source. A plurality of ionizing wires are electrically coupled at their one ends to the plus terminal of a low voltage source and at their other ends to the minus terminal of a low voltage source, in which the minus terminal is the common terminal of a high voltage source and a low voltage source. Therefore the ionizing wire may be heated by a low voltage source connected to its both ends to act as the heating wire, so that it increases the air temperature contacting with the air to be cleaned as well as burns the bacteria to perform the sterilization function. While it is influenced ill on the electrifying function and the ionizing function, since the voltage on one end of the ionizing wire may be disregarded in comparison with the voltage of the electrifying panel.

Also, an air cleaner of the invention generates a relatively larger amount of noxious gas harmful to human body since it uses the negative corona on the contrary to an air cleaner of the positive corona type, but it can prevent the leakage of the noxious gases therefrom using the ozone decomposing active coal. As a result, it may not reduce advantage on the invention.

BRIEF DESCRIPTION OF THE DRAWING

The invention will be described in detail with the reference to the accompanying drawings.

DETAIL DESCRIPTION OF THE INVENTION

Figure 4:
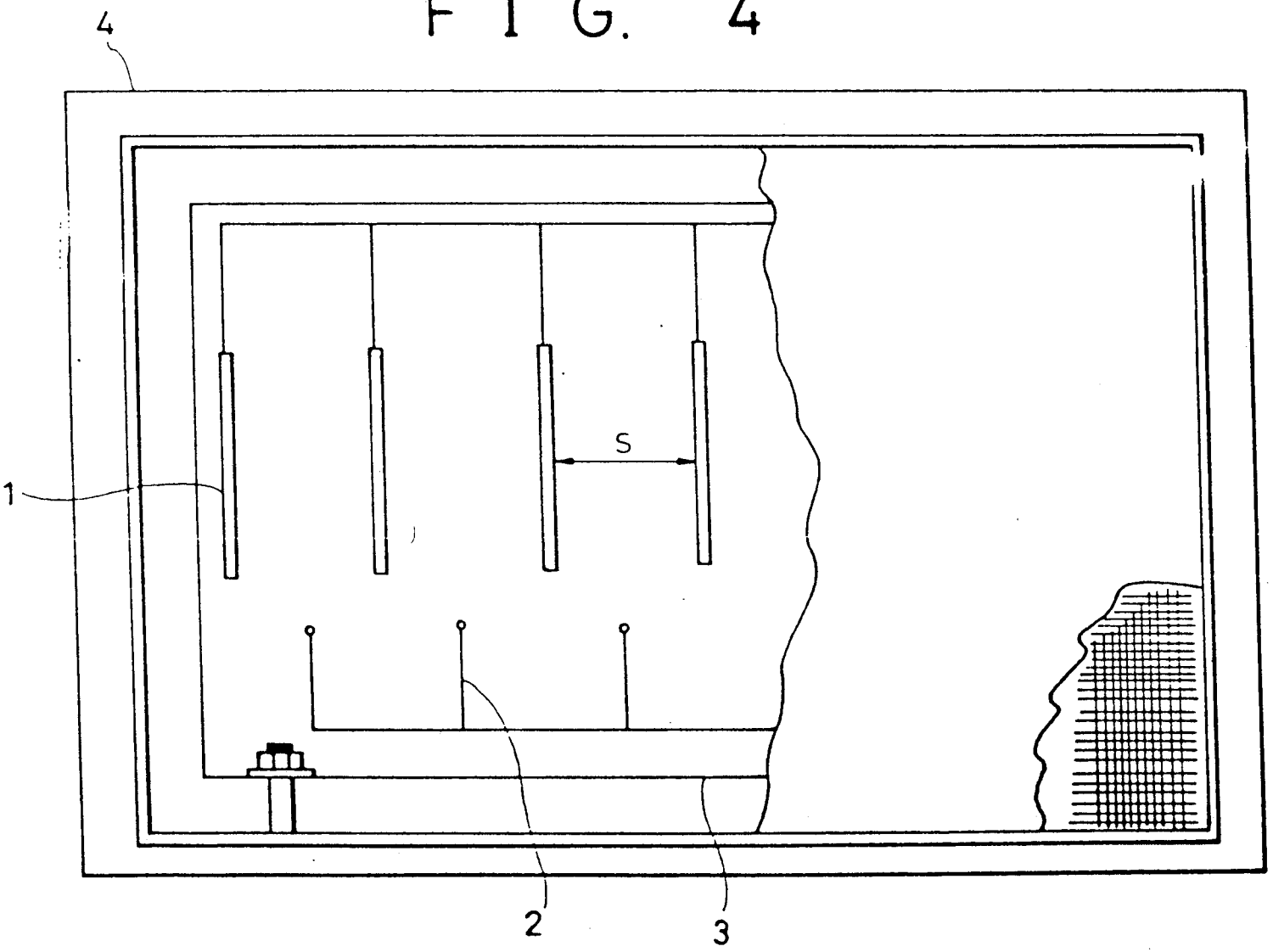
FIG. 4 is a schematical cross-sectional view showing one example of a conventional air cleaner.

Referring to FIG. 4, a conventional air cleaner includes case 4 forming the body of a air cleaner to protect its parts mounted therein and having an air inlet portion and an air outlet portion; a container unit 3 installed in case 4, which has the ionizing function, the dust collecting function and the ozone decomposing function; a collecting unit mounted in the container unit; a plurality of dust collecting panels 1 arranged at a predetermined space and in parallel to form air flow passages facing each other; and, a plurality of ionizing wires in parallel 2 which are installed in a collecting unit.

On the other hand, according to the invention, an air cleaner may be similar to the configuration of a conventional air cleaner as shown in FIG. 4 except for a dust collecting unit whose features will be explained thereinafter.

Figure 1:
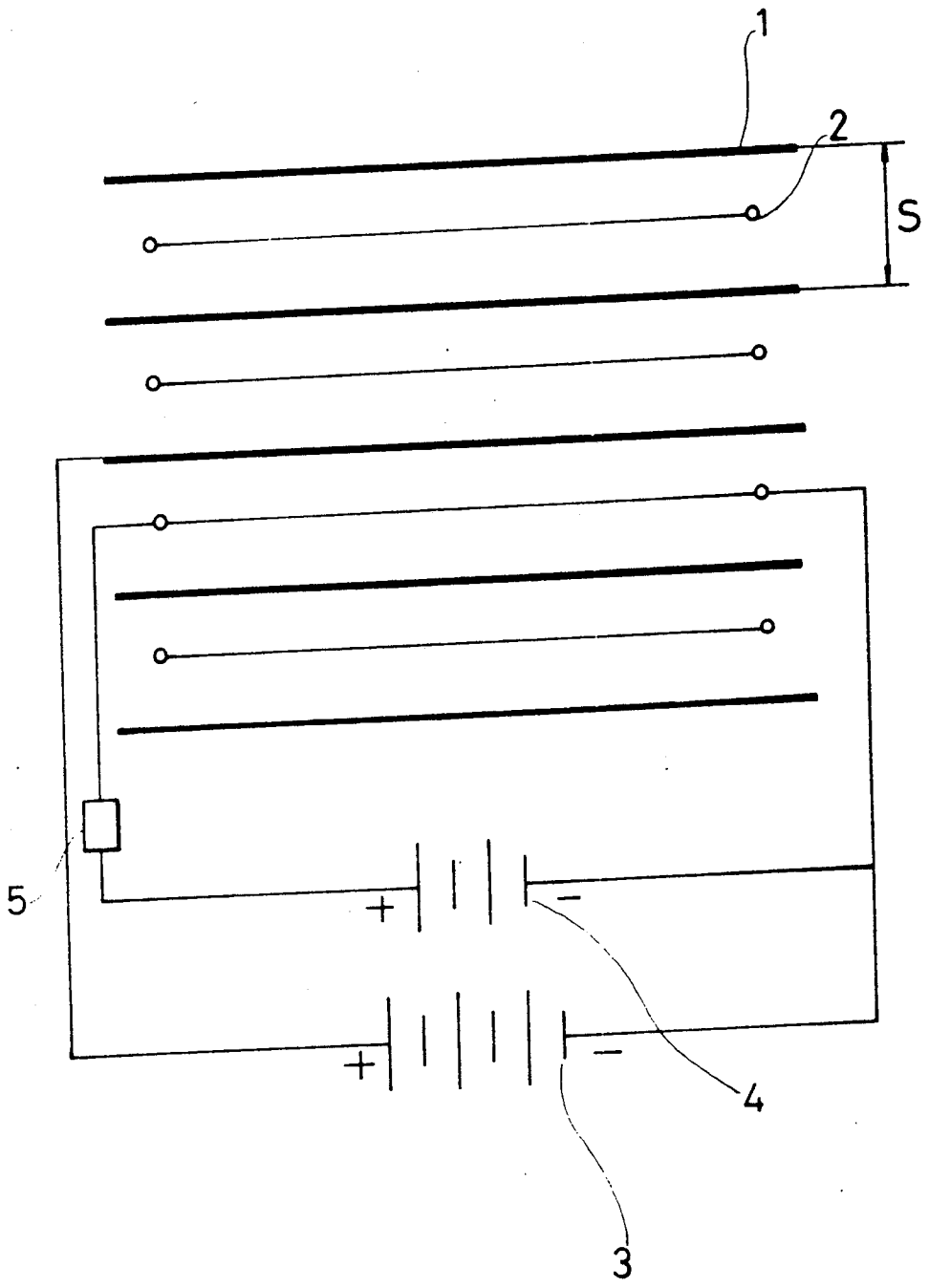
FIG. 1 is a schematical structure showing a dust collector according to the principle of the invention.
Figure 3:
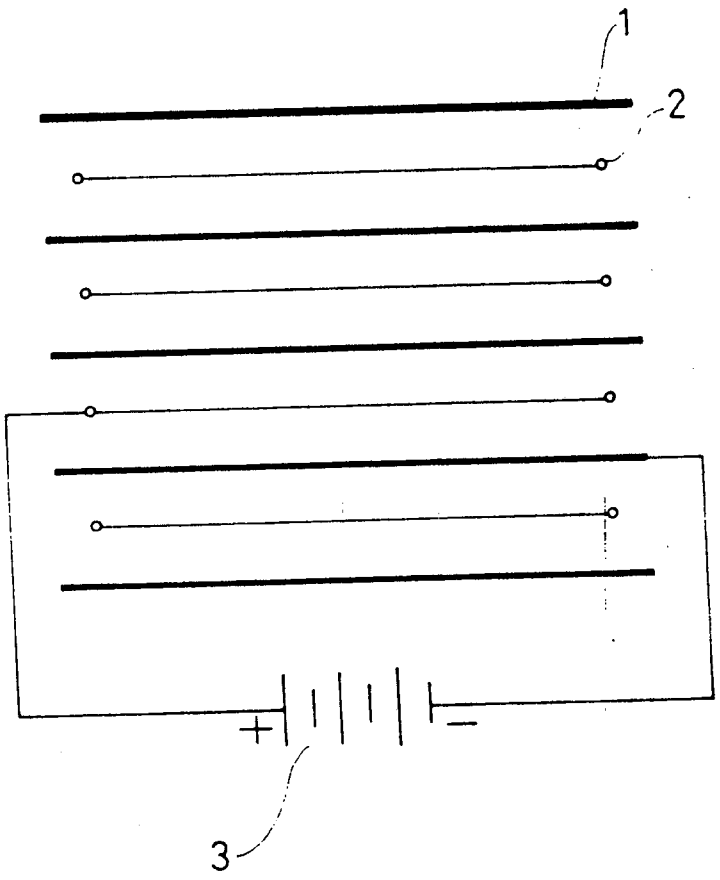
FIG. 3 is a schematical view showing one example of a conventional dust collector.
Figure 2:
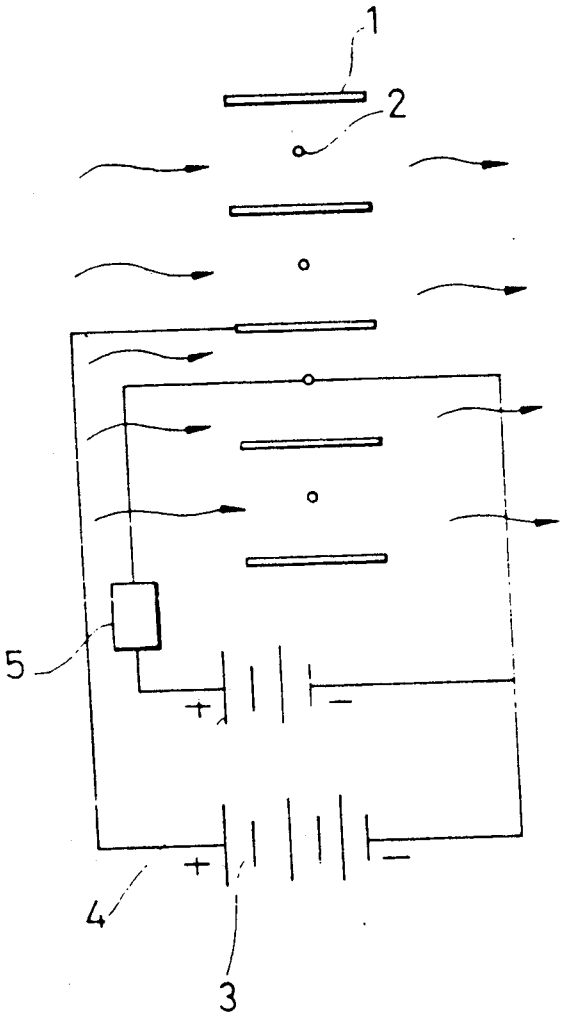
FIG. 2 is a side view illustrating an air circulating passage of a dust collector of FIG. 1.

Referring to FIG. 2, a dust collecting unit of the invention is constructed as follows:

A plurality of electrifying panels 1 for collecting the dust are arranged at a predetermined space and in parallel against each other to form the air flow passages therebetween. A plurality of ionizing wires 2 are disposed in the middle position between one panel and other panel, in which the length of ionizing wire 2 is shorter than that of electrifying panel 1. Two independent voltage sources 3 and 4 have the common terminal to supply the power source to ionizing wires 2 and electrifying panels 1, in which the common terminal is the minus terminal. Ionizing wires 2 have a relatively larger resistance to generate the heat when the current is applied thereto. Then, as the air intaken from the inlet portion is passed near ionizing wires 2, ionizing wires 2 heat the air flowing in their periphery to sterize the bacteria as well as to heat room. Thus, ionizing wire 2 is made of the heating wire such as nichrome wire having a relatively larger resistance.

Further, low voltage source 4 is connected at its plus terminal to one end of ionizing wires 2 to apply the power source, for example 24 V, 48 V, to ionizing wires 2 through a connector such as the socket, the receptacle, etc. Also, the minus terminal of low voltage source 4 is connected through a connector to the other end of ionizing wire 2 along with the minus terminal of high voltage source 3, so that it is formed as the common terminal. High voltage source 3 is connected at the plus terminal through a connector to one end of each of electrifying panels 1. Therefore, between electrifying panel 1 and ionizing wire 2, significant unequal electric field of the line to the panel is generated as shown in FIG. 2.

On the other hand, one end of ionizing wire 2 is connected to the plus terminal of low voltage source having the voltage of 24 V, but the voltage, for example 7 KV, applied to electrifying panel 1 is very larger than that applied to ionizing wire 2. Thus a relatively lower voltage have less influence on the electric field between electrifying panel 1 and ionizing wire 2.

When electrifying panels 1 and ionizing wires 2 are operated by applying the power source, they generate the negative corona discharge to form the negative ion flow between them. At this time, the dust particles in the air are made into an electric charge to have the negative ion in the course of the negative ion flow.

Then, the dust particles in the air charged into the negative ion are attracted to electrifying panels 1 electrified into the positive electric charge by the unequal electric field formed between electrifying panel 1 and ionizing wire 2, so that the negative electric charge of the dust particles is neutralized at electrifying panels 1, thereby being attached thereto. That is, the dust particles in the air are made into an electric charge at ionizing wires 2, and then being neutralized at electrifying panel 1 and attached thereto. While the air free of the dust particles is heated and sterized at a predetermined temperature by the heat generated at ionizing wires 2. Also, variable resistor 5 may be mounted between ionizing wires 2 and low voltage source 4 to adjust an amount of current applied to ionizing wires 2, thereby varying the calorifying value of ionizing wire 2.

As described above, it is noted that the invention may have the effects of the heating and the sterilization according to the applying of the low voltage source to the ionizing wire.

What is claimed is:

1. An air cleaner having a dust collector provided with a plurality of electrifying panels arranged at a predetermined space from each other, a plurality of ionizing wires interposed between said plurality of panels, and a voltage generating means for supplying the power source to said electrifying panels and said ionizing wires, comprising:

high voltage generating means having a positive terminal connected to said plurality of electrifying panels and a negative terminal connected to first ends of said plurality of ionizing wires; and low voltage generating means for supplying the power source connected to the other ends of said plurality of ionizing wires.

2. In an air cleaner as claimed in claim 1, wherein:

the negative terminal of said high voltage generating means and said ionizing wires form a the common terminal.

3. In an air cleaner as claimed in claim 1, wherein:

means for varying a value is connected between said low voltage generating means and said high voltage generating means to control calorifying of the ionizing wire.

4. In an air cleaner as claimed in claim 1, wherein:

said ionizing wire is a heating wire having a high resistance.

5. In an air cleaner as claimed in claim 1, wherein:

said high voltage generating means has at least a voltage output higher than said low voltage generating means, and said high voltage generating means and said low voltage generating means are a direct current power sources.

6. In an air cleaner having a dust collector provided with a plurality of electrifying panels arranged spaced-apart from each other, a plurality of ionizing wires disposed between said panels, and means for supplying electrical power to said electrifying panels and said ionizing wires, the improvement comprising:

high voltage generating means having a positive polarity terminal connected to a plurality of said electrifying panels and a negative polarity terminal connected to a plurality of connected across said ionizing wires, for generating a first voltage exhibiting a first amplitude; and low voltage generating means for supplying electrical power at a second voltage exhibiting a second and lower amplitude, connected to said ionizing wires.

7. In an air cleaner as claimed in claim 6, wherein said negative terminal and first ends of said ionizing wires form a common terminal.

8. In an air cleaner as claimed in claim 6, further comprised of means for varying a calorifying value connected between said low voltage generating means and said high voltage generating means.

9. In an air cleaner as claimed in claim 6, wherein said ionizing wires are heating wire having a high resistance.

10. In an air cleaner as claimed in claim 6, wherein said high voltage generating means has a voltage output higher than said low voltage generating means, and said high voltage generating means and said low voltage generating means are a direct current power source.

11. An air cleaner, comprising:

a plurality of spaced apart panels;

a plurality of means each having first and second ends, for ionizing particles of dust said plurality of ionizing means being interleaved between said corresponding paris of said spaced apart panels; and means for applying a first potential difference between said first and second ends of each of said plurality of ionizing means, and for applying a second and substantially greater potential between said first ends of each of said plurality of ionizing means and said plurality of panels.

12. An air cleaner having a dust collector provided with a plurality of electrifying panels arranged spaced-apart from each other, a plurality of ionizing wires interposed between said plurality of panels, and voltage generating means for supplying power to said electrifying panels and said ionizing wires, comprising:

high voltage generating means having a first terminal of a first electrical plurality connected to said plurality of electrifying panels and a second terminal of a second and electrically opposite polarity ends of said plurality of ionizing wires, said high voltage generating means exhibiting a first potential between said positive and negative terminal; and low voltage generating means coupled between the other ends of said plurality of ionizing wires and one of said positive and negative terminals, for supplying power at a second and lower potential across said first ends and the other ends of said plurality of ionizing wires.

* * * * *

UNITED STATES PATENT AND TRADEMARK OFFICE

CERTIFICATE OF CORRECTION

PATENT NO. : U.S. 5,045,095

DATED : September 3, 1991

INVENTOR(S) : Hee Sang YOU

It is certified that error appears in the above-identified patent and that said Letters Patent is hereby corrected as shown below:

IN THE ABSTRACT

**NOTE: The line count begins on line 1 of the actual Abstract text, not including the heading "ABSTRACT".

Line 1, change "comprises" to --with--;

Line 2, insert --a-- before "high";

Line 7, change "overrided comparing" to --overridden in comparison--.

Column 1, Line 7, change "a" to --an--, and insert --a-- before "heat";

Line 12, delete "said";

Line 18, insert --a-- after "having";

Line 19, change "the" (first occurrence) to --a--;

Line 20, change "is" to --are--, and change "ion" to --ions--;

Line 21, change "a" to --an--;

Line 22, change "are impinged against" to --impinge against--;

Line 23, change "dusts in air are" to --dust in air--, and change "collided" to --collides--.

UNITED STATES PATENT AND TRADEMARK OFFICE

CERTIFICATE OF CORRECTION

PATENT NO. : U.S. 5,045,095

DATED : September 3, 1991

INVENTOR(S) : Hee Sang YOU

It is certified that error appears in the above-identified patent and that said Letters Patent is hereby corrected as shown below:

Column 1, Line 24, delete "the", and change "movement" (first occurrence) to --motion--;

Line 27, change "equipped" to --furnished--;

Line 35, insert --terminal-- after "(+)";

Line 37, insert --terminal-- after "(-)";

Line 38, delete "the";

Line 40, delete "the" (first occurrence), and delete "of";

Line 52, insert --a-- before "two";

Line 54, delete "the";

Line 61, change "comparing with" to --in comparison to--;

Line 65, change "filters" to --filter--;

Line 67, delete "a";

Column 2, Line 3, change "an" to --a--;

Line 5, change "upon" to --of--;

Line 8, delete "a the";

UNITED STATES PATENT AND TRADEMARK OFFICE

CERTIFICATE OF CORRECTION

PATENT NO. : U.S. 5,045,095

DATED : September 3, 1991

INVENTOR(S) : Hee Sang YOU

It is certified that error appears in the above-identified patent and that said Letters Patent is hereby corrected as shown below:

Column 2, Line 13, delete "in";

Line 14, change "the indoor" to --indoors--;

Line 15, delete "the" (first & third occurrence), and change "the microbe" to --microbes--;

Line 18, change "removing" to --removal--;

Line 35, change "is" to --are of--;

Line 39, change "one-second" to --one-half--;

Line 44, insert --an-- before "ozone";

Line 54, insert --a-- after "heats";

BETWEEN Lines 55 & 56, insert --SUMMARY OF THE INVENTION--;

Line 58, delete "a";

Line 60, delete "the";

Line 62, change "an" to --the--;

Line 63, change "comprises" to --may use--, and delete "the".

UNITED STATES PATENT AND TRADEMARK OFFICE

CERTIFICATE OF CORRECTION

PATENT NO. : U.S. 5,045,095

DATED : September 3, 1991

INVENTOR(S) : Hee Sang YOU

It is certified that error appears in the above-identified patent and that said Letters Patent is hereby corrected as shown below:

Column 3, Line 5, change "overrided comparing" to --overridden (i.e., ignored) in comparison--;

Line 10, change "their one" to --one of their--;

Line 12, delete "their", and insert --of their-- after "one";

Line 18, change "its both" to --both of its--;

Line 20, change "the" to --a--;

Line 21, delete "While it is influenced ill on the";

Lines 22 - 25, Delete. Insert --While it is influenced ill on the electrifying function and the ionizing function, since the voltage on one end of the ionizing wire may be disregarded in comparison with the voltage of the electrifying panel.--;

Line 32, change "advantage on" to --the advantages provided by--;

Line 34, change "DRAWING" to --DRAWINGS--;

Line 37, change "schematical" to --schematic--;

Line 41, change "schematical" to --schematic--.

UNITED STATES PATENT AND TRADEMARK OFFICE

CERTIFICATE OF CORRECTION

PATENT NO. : U.S. 5,045,095

DATED : September 3, 1991

INVENTOR(S) : Hee Sang YOU

It is certified that error appears in the above-identified patent and that said Letters Patent is hereby corrected as shown below:

Column 3, Line 43, change "schematical" to --schematic--;

Line 49, change "having" to --has--;

Column 4, Line 12, change "sterize" to --sterilize--;

Line 13, insert --the-- after "heat";

Line 16, change "plus" to --positive--;

Line 19, insert --of-- after "socket";

Line 20, change "minus" to --negative--;

Line 22, change "minus" to --negative--;

Line 24, change "plus" to --positive--;

Line 25, insert --the-- after "of";

Line 27, insert --a-- before "significant";

Line 31, change "plus" to --positive--, and insert --4-- after "source";

Line 33, insert --much-- after "very";

Line 35, change "have" to --has--;

UNITED STATES PATENT AND TRADEMARK OFFICE

CERTIFICATE OF CORRECTION

PATENT NO. : U.S. 5,045,095

DATED : September 3, 1991

INVENTOR(S) : Hee Sang YOU

It is certified that error appears in the above-identified patent and that said Letters Patent is hereby corrected as shown below:

| | | |
|---|---|---|
| Column 4, | Line 39, | change "the" to --a--; |
| | Line 43, | delete "the" (third occurrence); |
| | Line 44, | change "ion" to --ions--; |
| | Line 45, | change "the" (first occurrence) to --a--; |
| | Line 51, | change "then being" to --are then--; |
| | Line 53, | change "sterized" to --sterilized--. |

UNITED STATES PATENT AND TRADEMARK OFFICE

CERTIFICATE OF CORRECTION

PATENT NO. : 5,045,095

DATED : September 3, 1991

INVENTOR(S) : Hee Sang You

It is certified that error appears in the above-identified patent and that said Letters Patent is hereby corrected as shown below:

Claim 2, Column 5, line 13, delete "the";

Claim 5, column 5, line 28, delete "a";

Claim 6, Column 5, line 40, delete "connected across";

Claim 9, column 6, line 9, change "wire" to -- wires--;

Claim 11, column 6, line 18, insert --,-- after "dust";

line 20, change "paris" to --pairs--;

Claim 12, column 6, line 28, change "plurality" to --polarity--;

line 36, insert --connected to first-- before "ends".

Claim 6, line 46, change "to" to --across--;

Signed and Sealed this

Tenth Day of November, 1992

*Attest:*

DOUGLAS B. COMER

*Attesting Officer*

*Acting Commissioner of Patents and Trademarks*